US010001754B2

(12) United States Patent
Rossier

(10) Patent No.: US 10,001,754 B2
(45) Date of Patent: Jun. 19, 2018

(54) SUPPORT FOR TREATING MICROMECHANICAL COMPONENTS

(71) Applicant: Universo S.A., La Chaux-de-Fonds (CH)

(72) Inventor: Gerard Rossier, La Chaux-de-Fonds (CH)

(73) Assignee: Universo S.A., La Chaux-de-Fonds (CH)

( * ) Notice: Subject to any disclaimer, the term of this patent is extended or adjusted under 35 U.S.C. 154(b) by 0 days. days.

(21) Appl. No.: 14/782,624

(22) PCT Filed: Mar. 26, 2014

(86) PCT No.: PCT/EP2014/056038

§ 371 (c)(1),
(2) Date: Oct. 6, 2015

(87) PCT Pub. No.: WO2014/177324

PCT Pub. Date: Nov. 6, 2014

(65) Prior Publication Data

US 2016/0041528 A1 Feb. 11, 2016

(30) Foreign Application Priority Data

Apr. 30, 2013 (EP) ..... 13166047

(51) Int. Cl.

| | |
|---|---|
| ***B25B 1/20*** | (2006.01) |
| ***G04D 1/06*** | (2006.01) |
| ***G04D 3/00*** | (2006.01) |
| ***G04D 3/08*** | (2006.01) |
| ***C25D 17/06*** | (2006.01) |

(Continued)

(52) U.S. Cl.
CPC ..... *G04D 1/06* (2013.01); *C25D 17/005* (2013.01); *C25D 17/06* (2013.01); *C25D 17/08* (2013.01); *C25D 21/10* (2013.01); *G04D 3/0069* (2013.01); *G04D 3/08* (2013.01)

(58) Field of Classification Search
CPC ..... G04D 1/06; G04D 3/08; G04D 3/0069
USPC .... 248/125.7, 131, 415; 211/70, 163, 71.01, 211/74–77
See application file for complete search history.

(56) References Cited

U.S. PATENT DOCUMENTS 5,054,624 A * 10/1991 Camp ..... A47F 5/02 211/163
7,891,397 B2 * 2/2011 Kramer ..... B65C 9/1819 156/538

(Continued)

FOREIGN PATENT DOCUMENTS

| | | |
|---|---|---|
| FR | 1 389 830 | 2/1965 |
| GB | 1 047 675 | 11/1966 |

OTHER PUBLICATIONS

International Search Report dated Mar. 17, 2015 in PCT/EP14/056038 Filed Mar. 26, 2014.

*Primary Examiner* — David Bryant
*Assistant Examiner* — Nirvana Deonauth
(74) *Attorney, Agent, or Firm* — Oblon, McClelland, Maier & Neustadt, L.L.P.

(57) ABSTRACT

A support for cleaning and/or galvanic deposition including a carrier structure including attachment points for watch hands each provided with a hole. The attachment points include at least one rigid pin, if necessary a conductive pin, onto which the hands are threaded via their hole and held apart from each other by a spacer.

15 Claims, 2 Drawing Sheets

(51) Int. Cl.

| | |
|---|---|
| ***C25D 17/00*** | (2006.01) |
| ***C25D 17/08*** | (2006.01) |
| ***C25D 21/10*** | (2006.01) |

(56) References Cited

U.S. PATENT DOCUMENTS

| | | | | |
|---|---|---|---|---|
| 8,636,259 | B2 * | 1/2014 | Manke | G01N 30/6047 211/78 |
| 2007/0176343 | A1 * | 8/2007 | Hsieh | B05B 13/0285 269/57 |

* cited by examiner

SUPPORT FOR TREATING MICROMECHANICAL COMPONENTS

This is a National Phase application in the United States of International Patent Application PCT/EP2014/056038 filed on Mar. 26, 2014 which claims priority on European Patent Application No. 13166047.6 filed on Apr. 30, 2013. The entire disclosures of the above patent applications are hereby incorporated by reference.

FIELD OF THE INVENTION

The invention relates to a support for the treatment of micromechanical components, for example watch hands. In particular, the invention concerns a support to perform cleaning and/or galvanic deposition on micromechanical components and notably a support of this type for performing galvanic deposition surface treatments on micromechanical components including a through orifice or hole such as watch hands or similar.

BACKGROUND OF THE INVENTION

Like many industrial micromechanical components, after being cut from a body of material, watch hands are cleaned and treated by galvanic deposition in an electrolyte bath so as to coat the hands with a thin coating, for example a gold layer to protect them from oxidation and to give them a colour providing an attractive appearance.

Galvanic deposition is a well known technique which consists in using a continuous electrical current to deposit a metal material on the surface of a conductive part, the metal being initially in the form of cations in solution in a solvent. The component to be treated must thus be excited.

To date, in order to clean or treat watch hands by galvanic deposition, the hands are placed in batches in a basket or on a multi-hooked support called a "bouclard" which is in turn placed in a cleaning bath or in the case of galvanic deposition, in a galvanic bath for a determined period of time depending on the desired thickness of deposition. In the case of galvanic deposition, the basket is of course electrically conductive. The basket is regularly shaken during the operation for improved cleaning and, in the case of galvanic deposition, to prevent adhesion of the hands by the creation of a bridge of material or coating defects caused by overlapping.

Unfortunately, with this method scratches occur causing a high scrap rate.

SUMMARY OF THE INVENTION

It is an object of the invention to propose a solution for improving the cleaning and/or quality of galvanic deposition.

The invention therefore concerns a support for treating micromechanical components particularly for cleaning and/or galvanic deposition, formed of a carrier structure having attachment points for the micromechanical components to be treated, the components each including at least one hole or through orifice, said support being characterized in that the attachment points are formed by at least one rigid pin onto which the micromechanical components are threaded via their holes and are held apart from each other by a spacer means.

According to a preferred embodiment, the spacer means comprises spacers made of material which may be electrically insulating, having a central through hole for the passage of the rigid pin and each spacer has a support track remote from the central hole on which the micromechanical component, typically the hand, rests.

Preferably, the track is defined by the trajectory, over an angular amplitude of 360°, of the end of a spoke whose length varies according to its angular position.

Advantageously, the spacer means is made of electrically insulating material and takes the form of a ring connected by branches to a central portion provided with a pierced hole for engaging the pin therein and the branches carry the track on which the micromechanical component rests.

According to a feature of the invention, the ring of the spacer means includes studs.

BRIEF DESCRIPTION OF THE DRAWINGS

The invention will be understood with the aid of the following description given by way of example with reference to the drawing which shows.

DETAILED DESCRIPTION OF PREFERRED EMBODIMENTS

Figure 1:
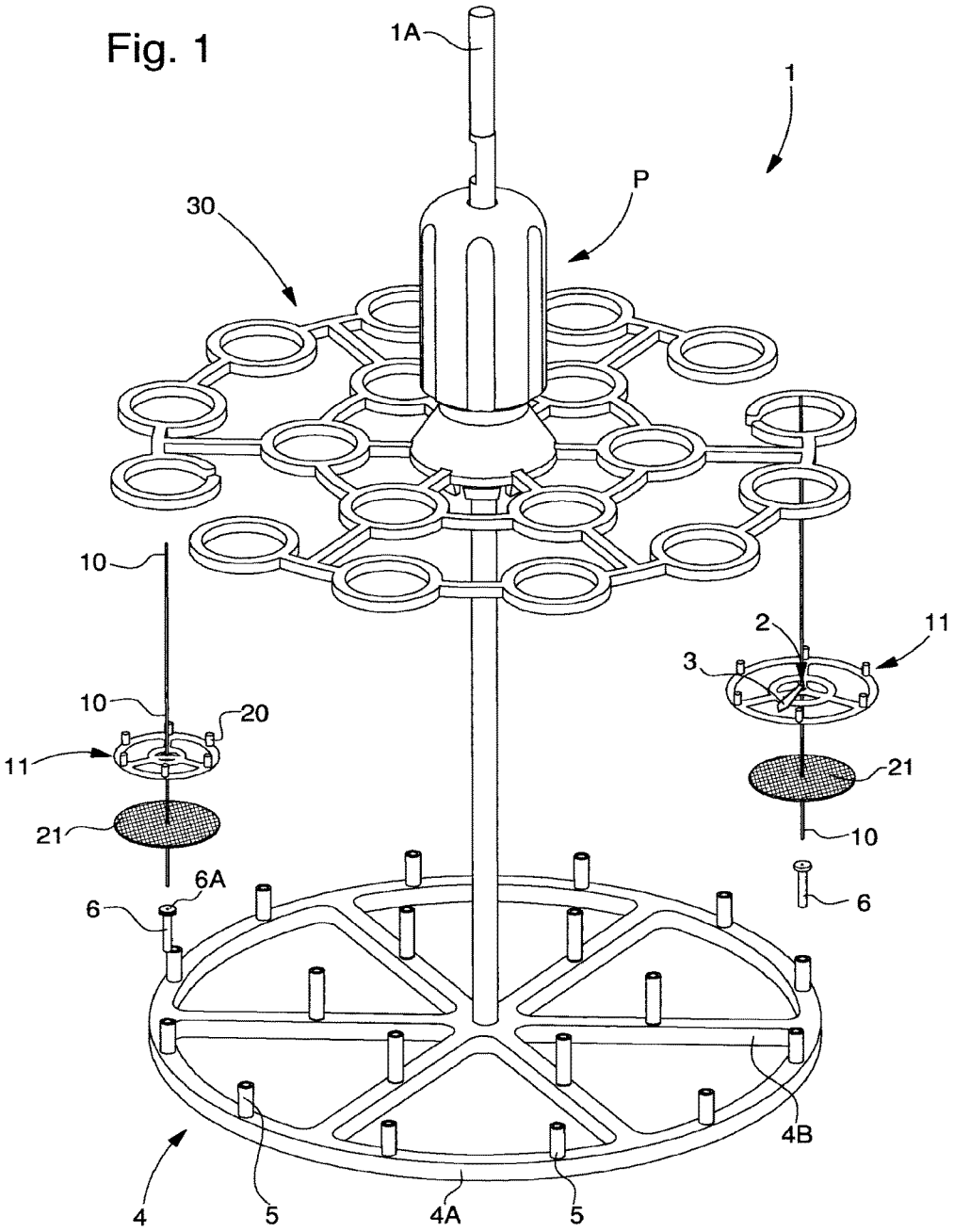
FIG. 1: an exploded view of a support for galvanic deposition.
Figure 2:
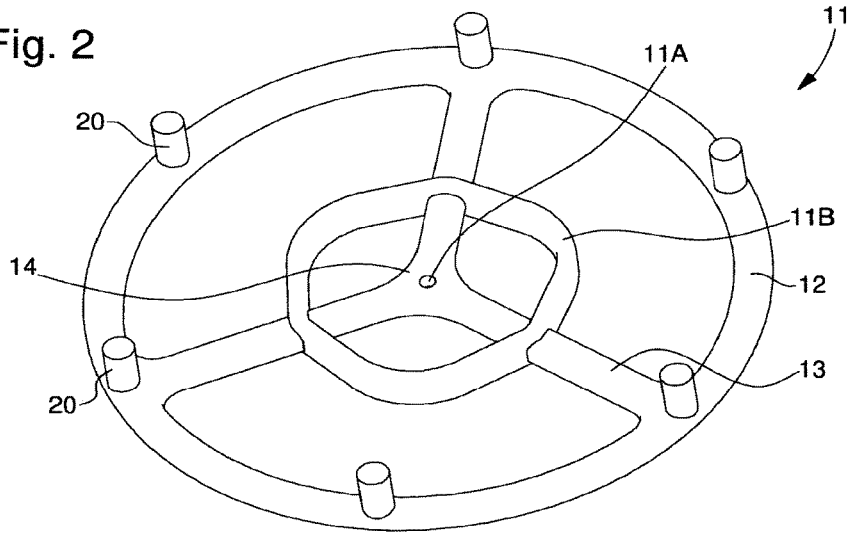
FIGS. 2 and 2A: respectively perspective and side views of a spacer means.
Figure 2A:
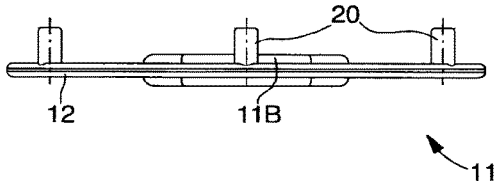
Figure 3:
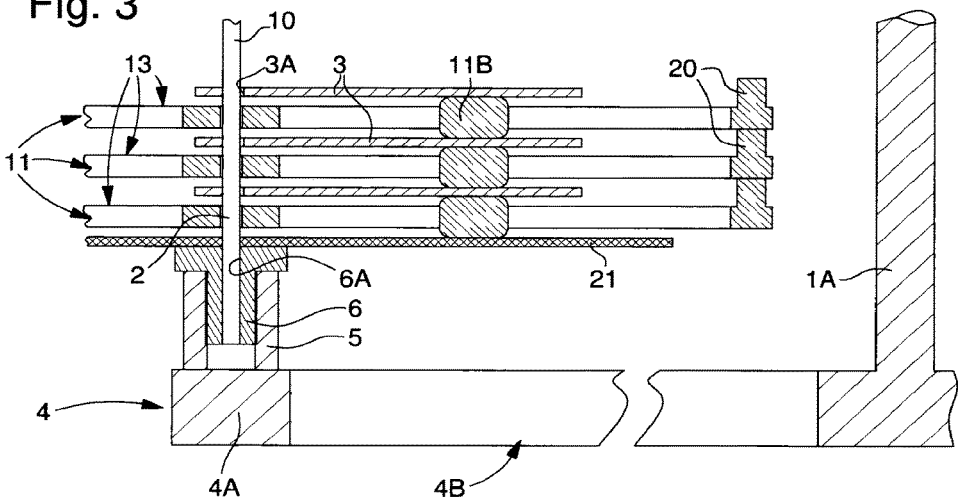
FIG. 3: partial cross-section of a support according to the invention in a simplified version.

Referring now to the drawing, a support 1 is shown for performing cleaning and/or galvanic deposition on micromechanical components. In the example below, the micromechanical components are watch hands, but it is of course clear that the support of the invention could be used with any other micromechanical component including an orifice or a through hole. This device, also called a "bouclard", loaded with components to be treated, is intended to be dipped into a cleaning and/or electrolyte bath and forms a cathode which cooperates with an anode to form a deposition on the surface of said components, typically a gold or rhodium or similar deposition.

The cleaning and/or galvanic deposition support is formed of a carrier structure 1 having attachment points 2 for watch hands 3 each provided with a hole 3A.

Hole 3A of the hand is used for mounting the hand on the drive outputs of the watch movement through the watch dial.

This support 1 conveys electric current and therefore has a current conductive element.

Advantageously, attachment points 2 are formed by at least one rigid conductive pin or rod 10 on which the hands are stacked via their hole 3A and held apart from each other by spacer means 11. The hands are mounted to rotate freely on pin 10 but the operating play is small since there must be a sufficient electrical contact between hand 3 and pin 10. This contact is preferably permanent to obtain a uniform deposition on the surface of the hands. The spacer means is preferably free to rotate relative to pin 10.

Conductive pins 10, for example made of steel, are preferably coated with a gold layer to improve the electrical contact with the holes 3A in the hands. Typically, pins 10 have a diameter of around 0.5 mm. It is important for the pins to be sufficiently rigid to withstand the rotations of the support without deformation during the deposition, rinsing and drying operations respectively performed on the components to be treated.

Support 1 includes a pierced plate 4 carried by a central shaft 1A for driving the plate in rotation and pins 10 are remote from said pivot shaft.

Pierced plate 4 has a base 5 intended to receive pins 10 at least indirectly, for example via an intermediate part 6, formed in the illustrated example by a shouldered tube inserted into the bases. This makes it possible to regularly change pins 10, which will be coated with deposition during the galvanic deposition operation. An electrically conductive connection is of course provided between pins 10 and central shaft 1A.

In the illustrated example, plate 4 is of generally circular shape. Pierced plate 4 takes the form of a hoop 4A connected to pivot shaft 1A by spokes 4B like the rim of a spoked bicycle wheel. Here the support has six spokes.

Bases 5 are carried by the spokes and/or the hoop. Each base is hollow with a conductive internal surface which is intended to receive the bottom of pin 10 or of intermediate part 6 which then houses the bottom of pin 10. The height of the base is around twice the thickness of hoop 4A here.

Structure 1 including the central shaft, plate 4, the bases, intermediate parts and pins are made of electrically conductive material, the current originating from shaft 1A fixed to a current source belonging to the galvanic deposition machine.

In an advantageous embodiment, spacer means 11 comprises spacers made of electrically insulating material having a central hole 11A for the passage of rigid pin 10 and each spacer has a support track 11B which is remote from central hole 11A and on which the hand rests. The only function of this track 11B is to support the hand at a point remote from the hole of said hand. The hand is thus supported in the hole and on track 11B.

Preferably, track 11B is defined by the trajectory, over an angular amplitude of 360°, of the end of the spoke whose length varies according to its angular position. Thus, the track will be closer to or further from the pin such that the track does not describe a circle of constant radius. The desired result will be understood below.

During the rotation of support 1 in the bath, the hand must, simply due to gravity, travel over track 11B of the spacer and there are two solutions to achieve this.

In one embodiment, pins 10 are parallel to the general pivot shaft 1A, but during assembly in the electrolytic bath, said general pivot shaft is mounted in an inclined manner relative to the vertical, so that during rotation of the support about its shaft 1A, the hand travels along track 11B with a contact area that moves, which improves the uniformity of deposition. If the track were circular, the resting point of the hand on the track would always be the same and due to this contact, there would be no deposition in this area.

In an alternative embodiment, pins 10 are inclined relative to the central pivot shaft 1A of the support which is held vertical in the electrolytic bath.

Spacer means 11, which is made of electrically insulating material, takes the form of a ring 12 connected by branches 13 to a central portion 14, which is provided with a pierced hole for engaging a pin 10 therein and the branches carry track 11B which is not conductive. Typically, these rings 12 may be made of polyamide. It will also be noted that track 11B is raised relative to branches 13.

Ring 12 of the spacer means carries, on one surface thereof, studs 20 perpendicular to the plane of the ring, studs 20 acting as support for the spacer means located above. Six regularly distributed studs are shown here.

Branches 13 carry track 11B sideways, and said track is positioned above the level of the branches.

At the bottom of the stack of spacer means 11 there is placed a washer 21, which is called a stabilizer washer, and is made of electrically insulating material and pierced.

Stabilizer washer 21 prevents spacer means 11 from being placed in a skewed position. This is a disc with a holed or meshed surface.

The washer is supported on intermediate part 6 which is used for mounting the pin on the base. This intermediate part has an enlarged head 6A.

The stacks of spacer means are held in place by a pierced cover 30 which will, for example, be fixed to the general pivot shaft 1A by a securing means such as a clamp P.

In the diagram, cover 30 is formed of circles connected to each other by longilineal elements. The centre of these circles coincides with the position of pins 10.

The above description was made with reference to an application of a support to galvanic deposition on micromechanical components and in particular watch hands, but it is of course clear that this application is not limiting and that according to a variant this support may be used for cleaning micromechanical components, in this case hands. In that case, pins 10 are not necessarily made of electrically conductive material, and the spaces are not made of insulating material.

What is claimed is:

1. A support for treating micromechanical components, or for cleaning or galvanic deposition, comprising: a carrier structure including attachment points for the micromechanical components to be treated, the components each including at least one hole; wherein the attachment points include at least one rigid pin onto which the micromechanical components are threaded via a respective hole therein, the components being held apart from each other by a spacer element, wherein the spacer element includes spacers including a central through hole for passage of the rigid pin, and the spacer element further includes branches extending from a central portion including the central through hole, and wherein each spacer includes a support track which encloses the central through hole and is separated from the central through hole by the branches, the support track being thicker than the branches such that the micromechanical component rests on the support track.

2. The support for treating micromechanical components, or for cleaning or galvanic deposition according to claim 1, wherein the support track is defined by a trajectory, over an angular amplitude of 3600, of an end of a spoke whose length varies according to angular position thereof.

3. The support for treating micromechanical components, or for cleaning or galvanic deposition according to claim 1, wherein the spacer element includes a ring connected by the branches to the central portion including the central through hole for engagement of the at least one rigid pin.

4. The support for treating micromechanical components, or for cleaning or galvanic deposition according to claim 3, wherein the ring of the spacer element includes studs.

5. The support for treating micromechanical components, or for cleaning or galvanic deposition according to claim 1, wherein the at least one rigid pin is conductive.

6. The support for treating micromechanical components, or for cleaning or galvanic deposition according to claim 5, wherein the spacers are made of electrically insulating material.

7. The support for treating micromechanical components, or for cleaning or galvanic deposition according to claim 5, wherein the pin includes a gold coating.

8. The support for treating micromechanical components, or for cleaning or galvanic deposition according to claim 1, wherein the support includes a pierced plate carried by a pivot shaft to drive the plate in rotation.

9. The support for treating micromechanical components, or for cleaning or galvanic deposition according to claim 8, wherein the pierced plate includes a hoop connected to the pivot shaft by spokes and the plate supports hollow bases configured to receive a bottom of the at least one rigid pin.

10. The support for treating micromechanical components, or for cleaning or galvanic deposition according to claim 1, wherein the support includes an aerated cover.

11. An assembly comprising: a support including a plurality of micromechanical components, and the support including a carrier structure including attachment points for the micromechanical components to be treated, the components each including at least one hole, wherein the attachment points include at least one rigid pin onto which the micromechanical components are threaded via a respective hole therein, the components being held apart from each other by a spacer element, wherein the spacer element includes spacers including a central through hole for passage of the rigid pin, the spacer element further including branches extending from a central portion including the central through hole, wherein each spacer includes a support track which encloses the central through hole and is separated from the central through hole by the branches, the support track being thicker than the branches such that the micromechanical component rests on the support track, and wherein the micromechanical components are watch hands.

12. The support for treating micromechanical components, or for cleaning or galvanic deposition according to claim 8, wherein the pierced plate includes a hoop connected to the pivot shaft by spokes and the plate supports hollow bases configured to receive a bottom of an intermediate part.

13. A support for treating micromechanical components, or for cleaning or galvanic deposition, comprising: a carrier structure including attachment points for the micromechanical components to be treated, the components each including at least one hole; wherein the attachment points include at least one rigid pin onto which the micromechanical components are threaded via a respective hole therein, the components being held apart from each other by a spacer element, wherein the spacer element includes spacers including a central through hole for passage of the rigid pin, wherein each spacer includes a support track which is remote from the central hole and on which the micromechanical component rests, wherein the spacer element includes a ring connected by branches to a central portion including a pierced hole for engagement of the rigid pin and the branches support the track, wherein the track is raised relative to the branches, and wherein the ring of the spacer element includes studs.

14. A support for treating micromechanical components, or for cleaning or galvanic deposition, comprising: a carrier structure including attachment points for the micromechanical components to be treated, the components each including at least one hole; wherein the attachment points include at least one rigid pin onto which the micromechanical components are threaded via a respective hole therein, the components being held apart from each other by a spacer element, wherein the spacer element includes spacers including a central through hole for passage of the rigid pin, and the spacer element further includes a support surface extending from a central portion including the central through hole, and wherein each spacer includes a support track which encloses the central through hole and is separated from the central through hole by the branches, the support track is thicker than the branches such that the micromechanical component rests on the support track.

15. The support for treating micromechanical components, or for cleaning or galvanic deposition according to claim 12, wherein the plate carries hollow bases configured to receive a bottom of the at least one pin or of an intermediate part, the intermediate part includes an enlarged head abutting a stabilizer washer.

* * * * *